United States Patent [19]

Schauffelle et al.

[11] 4,212,151

[45] Jul. 15, 1980

[54] MANUFACTURE OF COMPACTED STRAND

[75] Inventors: Siegfried A. Schauffelle, Marion, Ind.; Angelo P. Barone; Lloyd W. Beamish, both of Sycamore, Ill.

[73] Assignee: The Anaconda Company, Greenwich, Conn.

[21] Appl. No.: 948,865

[22] Filed: Oct. 5, 1978

[51] Int. Cl.[2] ..... D02J 1/00

[52] U.S. Cl. ..... 57/9; 57/138

[58] Field of Search ..... 57/1, 3, 6, 9, 138, 57/215, 219, 311; 174/128

[56] References Cited

U.S. PATENT DOCUMENTS

| | | | |
|---|---|---|---|
| 264,529 | 9/1882 | Hallidie | 57/138 X |
| 433,917 | 8/1890 | Warner . | |
| 614,453 | 11/1898 | Ferranti . | |
| 1,943,086 | 1/1934 | McKnight . | |
| 1,943,087 | 1/1934 | Potter et al. . | |
| 2,032,308 | 2/1936 | Pritchard | 57/138 X |
| 2,156,652 | 5/1939 | Harris | 57/138 X |
| 3,142,145 | 7/1964 | Blanchard | 57/9 |
| 3,164,670 | 1/1965 | Ege . | |
| 3,172,947 | 3/1965 | Fredrickson et al. . | |
| 3,760,093 | 9/1973 | Pemberton . | |
| 3,823,542 | 7/1974 | Pemberton . | |

*Primary Examiner*—Donald Watkins
*Attorney, Agent, or Firm*—Pennie & Edmonds

[57] ABSTRACT

The method and apparatus for forming round conductors directly on a strander and stranding the formed conductors in one or more helical lays, in either direction, on a core. The strander supports a forming apparatus including a plurality of pairs of cooperable forming rolls between which the round conductor passes during reformation.

7 Claims, 4 Drawing Figures

MANUFACTURE OF COMPACTED STRAND

BACKGROUND OF THE INVENTION

1. Field of the Invention

The present invention is directed to the method and apparatus for forming conductors directly on a strander in the manufacture of compacted strand.

2. Description of the Prior Art

Electric cables customarily are made by stranding together a plurality of conductors in layers, a first layer of which surrounds a core comprising a single center conductor, while a second layer surrounds the first layer, and so on. The geometry of the cable cross-section is such that six conductors fit firmly around the single center conductor, twelve conductors fit firmly around the six, eighteen conductors fit firmly around the twelve, and so forth, with the number of conductors forming each cable equal exactly to $3n^2+3n+1$ wherein n represents the number of layers surrounding the single center conductor.

Concentric layer conductors have large overall diameters for a given conductance, or cross-section of metal. This is because of the plurality of open spaces or interstices found between each of the conductors. It is known in the prior art that the conductors of concentric lay conductors may be crushed or compacted after the layers have been applied thereby to cause the metal of a conductor to flow into a space or interstice and in this manner to reduce the overall diameter of the conductor. A patent of the prior art illustrating an apparatus and method for accomplishing this end is U.S. Pat. No. 1,943,087 to F. M. Potter et al. Potter et al, which is still rather representative of the state of the art, utilizes a plurality of compacting rolls comprising rolling units in the manufacture of round compacted strand. In Potter et al, round wire is stranded and compacted at a roll station and according to Potter et al each succeeding layer is stranded and compacted in the same lay direction. The compacting of a standard conductor, however, changes the geometrical dimensional relationships so that a layer with six more wires than the underlying layer no longer sits naturally onto the conductor. To compensate for the reduction in diameter of the conductor core by compacting, the individual diameters of wires in succeeding layers are disclosed as being reduced in dimension. While this has a significant advantage in that all of the carriers of the stranding machine are utilized, it also introduces a serious disadvantage in that a multiplicity of different wire sizes are required to be drawn and stocked. A further disadvantage of the Potter et al patent relates to the necessity to reduce the length of stranding lay substantially below the maximum allowed by the American Society for Testing Materials (ASTM) and other industry standards. This is 16 times the diameter for copper (see ASTM B 496-69) and for Class B strand aluminum (see ASTM B 400-70). Shortening of the lay adds significantly to the cost of manufacturing since it reduces the hourly production of the stranding machines.

The aforementioned patent teaches that conductors may be compacted by means of pressure rolls. More recently, it has also been suggested to carry out the compaction of conductors by pulling the conductors through a wire drawing-type die after application of each layer of conductors. However, conductors fabricated by either of the methods or apparatus, using industry teachings for the selection of wire size and lay lengths, has been characterized by wide varieties of temper, due to uneven work hardening through the section of the conductor. Typically, the central wires have been excessively hardened, and it has been found that failure occurs within the central wires when the conductors are flexed or tensioned at an earlier period of time than would be expected for a conductor of uniform hardness throughout its section and, as a result, the load is not evenly distributed and failure will occur earlier than in a conductor of uniform hardness throughout.

A very early patent wherein there is a forming operation although not on a strander is U.S. Pat. No. 433,917 to E. P. Warner. The Warner patent, thus, relates to a method of manufacturing electric conductors and describes that a pair of strands coated with a winding or braiding may be passed through a pair of revolving dies to effect a change in the cross-section in each strand. The strand is round and assumes a D-shaped configuration upon operation of the dies. The two strands are laid together along their flat faces, caused to move to a die and bound together with a serving. The Warner patent, while it does disclose the forming of a pair of strands from a round to a D-shaped configuration, neither discloses nor does it suggest that the individual strands are formed on a strander, and the strands are not compacted thereby to be reduced in cross-section. The strands are only subject to a rearrangement of their geometrical cross-section.

SUMMARY OF THE INVENTION

The present invention is in the method and apparatus for forming conductors directly on the strander of any type including tubular and rigid, among others as are commonly known, in the manufacture of compacted strand. The present invention may be employed in the manufacture of compacted strand comprised of copper, aluminum and other metals wherein conductors of round configuration are drawn toward the individual formers of the strander, shaped to a non-round cross-section and helically applied as a stranding lay to a core as the core and shaped conductors move toward a compacting die. The core may be a single center conductor or a single center conductor having one or more stranding lays thereover, as determined by the particular step of the overall operation under consideration. The shaping of conductors permits a maximum stranding lay for each layer and the cable has a reduced diameter for a given conductance. The degree of work hardening throughout the cross-section will be relatively uniform.

Because of the use of shaped wires, shaped on the strander in the manufacture of compacted strand a very dense and uniform cable can be fabricated. The cable is subject to fewer breaks, less galling and other manufacturing problems as are known because the friction developed through a rolling operation of the former is less than friction developed in prior art stranding through a drawing operation.

Other objects and advantages of the present invention will become clear as the specification to be read and considered in conjunction with the drawing continues.

DESCRIPTION OF THE PREFERRED EMBODIMENT

Figure 1:
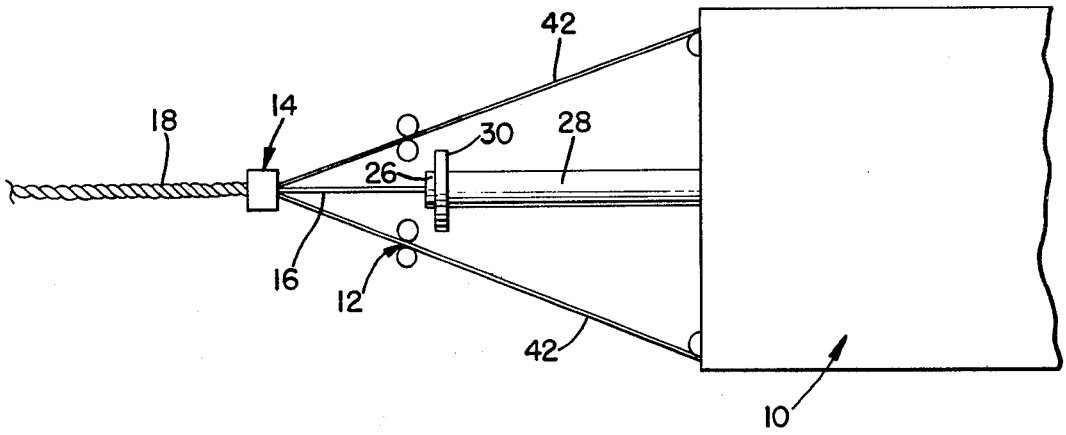
FIG. 1 is a schematic view in elevation of the apparatus of the present invention.

As indicated, the present invention describes the method and the apparatus for forming round wires directly on a strander during the overall manufacture of compacted strand. The apparatus of the invention is illustrated schematically in FIG. 1 and includes a strander 10, a former 12, and a die 14 for compacting the shaped conductor to be helically wound around thereby to form a layer on core 16. The product, which may be an intermediary product, is a cable 18 compacted in cross-section by action of the die 14.

The cable 18, depending upon the number of wires shaped on the strander, may include a single central conductor and a first layer of conductors including a plurality of six conductors or a second layer surrounding the first layer including a plurality of twelve conductors. The total number of conductors of which the cable is comprised may be determined by the formula $3n^2+3n+1$ wherein n equals the number of layers surrounding the single central conductor.

The apparatus illustrated schematically in FIG. 1 may be supported by any particular frame structure (not shown) thereby to carry out the fabricating operation. Further, the strander may comprise any particular type of strander, such as a rigid or tubular or any other strander known to the prior art.

In general, the "rigid strander" may be thought of as a strander from which wire is paid off in a manner such that there is no twisting of the wire in movement from the individual bobbins to the wire's position on the strand. The aforementioned Potter et al patent is typical of a rigid strander. The "tubular strander" may be thought of as a strander which twists the individual wires on its axis as the wire proceeds from the bobbin to its strand position. The strander of the present invention may be of either of the aforementioned types, each of which is well known as to its structural makeup and operation; and, therefore, the strander will be described only as is necessary to complete the description of the apparatus of the present invention.

Figure 2:
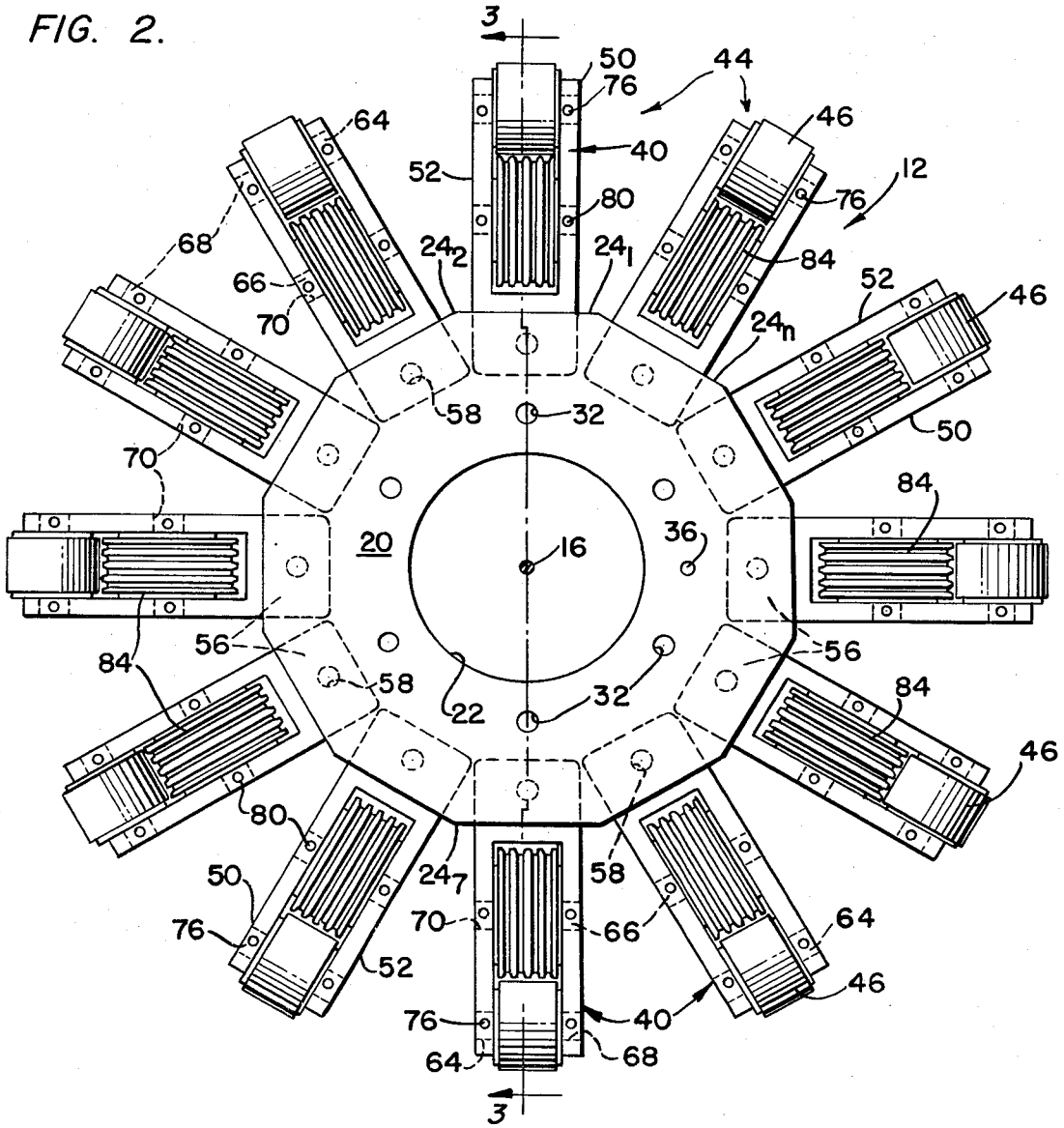
FIG. 2 is a section as seen along the line 2—2 in FIG. 1 illustrating the former carried by the strander.

Referring to FIG. 2, the former 12 includes a plate 20 which may be considered a lay plate. The lay plate generally is of annular outline having a circular inner diameter and an outer perimeter following the shape of a regular polygon. The lay plate which is perhaps best illustrated in FIG. 2 includes a plurality of faces $24_1$, $24_2 \ldots 24_n$ wherein n is the number of the conductors of which the layer being formed is comprised. In the Figure, the lay plate 20 includes a plurality of 12 faces such that, accordingly, the lay plate could be used on the strander in the manufacture of compacted cable 18 having an outer layer comprised of either six or twelve strands. If the lay plate carried by the strander was to form a layer having a plurality of eighteen conductors, as may be appreciated from the following description, the lay plate would have to include a plurality of eighteen faces.

A collar 26 (see FIG. 1) carried at one end of a tubular member 28, the latter of which is supported by strander 10 in any particular manner as is convenient, supports the lay plate 20. More particularly, the collar includes a portion having an outer diameter equal to the inner diameter 22 to be received within the confines of the lay plate. A flange 30 comprising an annular portion of the collar serves as a surface to be juxtaposed to the rear or downstream surface of the lay plate. The flange 30 similarly could be comprised of a separate plate supported on the tubular member and secured to the collar.

Both the lay plate 20 (see FIG. 2) and the flange 30 are formed with a plurality of holes 32 located at equal radial positions measured from a central axis 34 and at circumferentially spaced locations therearound. A bolt (not shown) or some other form of mechanical fastener may be utilized in releaseably mounting the lay plate on the strander.

A further hole 36 may be formed in the lay plate for purposes of alignment of the lay plate on the strander. To this end, the collar will include an alignment stud (not shown) which is adapted to be received into the hole.

A forming assembly 44 for shaping a conductor 42 to a configuration different from that of round is carried by the lay plate. The forming assembly operates on a single conductor and, as will be appreciated, a number of forming assemblies equal to the number of conductors in the outer layer of the compacted cable 18 are supported by the lay plate. In the illustration of FIG. 2, if the cable 18 includes a plurality of twelve wires in the outer layer, a forming assembly will be supported on each of the faces $24_1$, $24_2 \ldots 24_{12}$; whereas, if the outer layer of the cable 18 included only a plurality of six conductors, the forming assemblies need only be located at alternate faces, such as faces $24_1$, $24_3 \ldots 24_{11}$.

Figure 3:
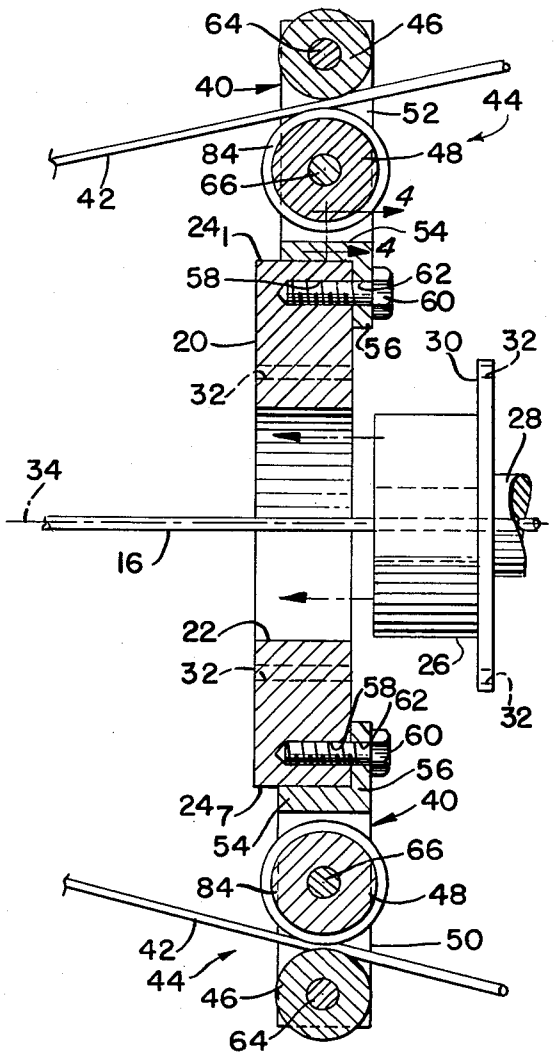
FIG. 3 is a section as seen along the line 3—3 in FIG. 2 illustrating the structure for mounting each former; and, FIG. 4 is an expanded, fragmentary view in section as seen along the line 4—4 in FIG. 3.

Each of the forming assemblies may be considered as being of identical makeup. Referring to FIGS. 2 and 3, it may be seen that the forming assemblies comprise a mount 40 a roller 46 and a roller 48, both carried by the mount. The roller 46 may be considered the "upper" roller while the roller 48 may be considered the "lower" roller.

The mount 44 includes a pair of arms 50, 52 which extend in parallel, spaced relation from the upper surface of a web 54. A flange 56 extends from the lower surface of the web. Each of the arms generally are rectangular, although preferably the upper corners are rounded, and the flange may either be formed in a like outline or to the outline of a teardrop. The two arms extend from opposite edges of the web while the flange extends from one of the edges removed therefrom by 90°.

A plurality of bores 58 are formed in the lay plate 20 at equal radial dispositions on radii which bisect each face $24_1$, $24_2 \ldots 24_n$. Each bore is tapped and a bolt 60 or the equivalent passing through a hole 62 in flange 56 may be used to secure the lay plate 20 and forming assemblies 44. As illustrated in FIG. 3, the lower surface of web 54 is flat thereby to rest on the face $24_1$ providing a rigid securement of the forming assembly 44 on the lay plate 20.

The upper roller 46 and the lower roller 48 are mounted between the arms 50, 52 by a pair of pins 64, 66, respectively. To this end, each arm includes a pair of upper holes 68 and a pair of lower holes 70. The pins are supported within each pair of holes and, in turn, support the individual rollers for rotation. The upper pin includes a pair of flats (not shown) adjacent the ends and the lower pin includes a pair of flats 74, similarly located. The flats in pin 64 cooperate with a pair of set screws 76 which may be threaded into and out of a pair of tapped bores (not shown), while the flats in pin 66 cooperate with a pair of set screws 80 which likewise may be threaded into and out of a pair of tapped bore (also not shown). Thus, the set screws locate the pins both rotationally and axially in the holes 68, 70. The upper roller 46 and the lower roller 48, thus, are capable of rotation relative to the pin upon which it is supported. Both the pins and the rollers preferably will be formed of a material which not only is sturdy and capable of long life but of a material which is characterized by a low degree of friction developed between the sliding surfaces. Further, a bushing or a bearing (not shown) may be press-fit or otherwise received within the roller to accomplish this end.

Figure 4:
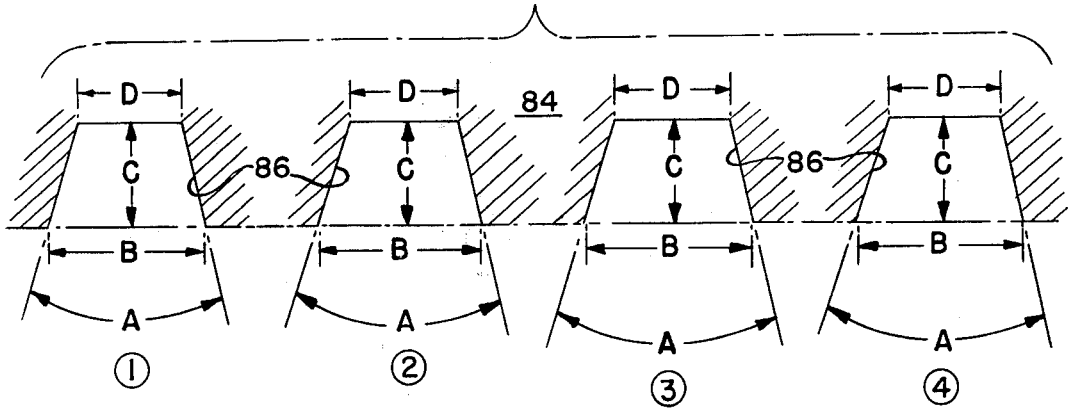

As may be seen in FIG. 2 and 3, the rotational axis for the upper roller 46 and the lower roller 48 are placed such that the rollers are not in surface-to-surface contact, but rather there is a gap therebetween. A sleeve 84 which perhaps may be seen to best advantage in FIG. 3 and in the fragmentary, expanded view of FIG. 4, is press-fit or otherwise securely but releaseably mounted on the lower roller 48, thereby to substantially fill the gap between it and the upper companion roller 46. The sleeve includes a plurality of grooves which are parallel, one to the other and circumferentially disposed around the sleeve. The sleeve may be formed of low carbon steel, case-hardened 1/32 DP. while the other structure of the forming assembly may be formed of 1018 steel.

The individual grooves are illustrated in FIG. 4. As illustrated, the grooves are of trapezoidal outline, although it should be pointed out that the grooves may be of any particular outline, such as a keystone or wedge-shaped in outline, for example, within the scope of the present invention. The particular dimensions of the grooves may be as characterized in the following table:

| Groove (from left to right) | Dimension A | B | C | D |
|---|---|---|---|---|
| 1 (1/0 wire) | 30° | .091 | .066 | .056 |
| 2 (2/0 wire) | 30° | .102 | .075 | .061 |
| 3 (3/0 wire) | 30° | .113 | .084 | .068 |
| 4 (4/0 wire) | 30° | .127 | .094 | .077 |

In operation, an endless core 16 which may be a single conductor, a 7/conductor compact, a 19/conductor compact, etc., is moved in a downstream direction (from right to left in FIG. 1) through both the strander 10 and former 12 to a position at die 14. Prior to entry to the die, a layer of shaped conductors is received on the core. In the embodiment as illustrated and described herein, the core will comprise a 7/conductor compact and a layer of twelve shaped conductors will be received thereover. The strander 10 is of conventional form and may be considered either as a "tubular" or "rigid" strander supporting a plurality of rolls or bobbins (not shown) from which the aforementioned plurality of conductors having a round configuration may be drawn. The strander and the former are located such that the conductors drawn toward and beyond the forming assembly 44 following the shaping operation are laid on the core 16 in a helical pattern. The individual conductors all will be of the same size and shaped within one of the grooves 86 in sleeve 84, for example, the groove 2 will be utilized to shape the conductor. The upper roller 46 applies pressure to the round conductor so that the conductor deforms in geometrical cross-section to approximate the shape of the groove within which it is confined. The formed conductor when helically laid on the core forms a very dense and substantially uniform cable which is compacted in the die 14. Because rolling friction is less than drawing friction, there will be fewer breaks, galling and other manufacturing problems encountered in the formation of compacted cable utilizing the method and the apparatus of the present invention. Further, the method and the apparatus can be utilized if the underlying core is compacted of regular strand, the method and the apparatus can be used for forming compacted cable comprising aluminum, copper or wires of other metals, and as heretofore described, the strander may either be "tubular", "rigid" or of any other particular type, such as planetary.

The following data has been determined in the fabrication of compacted cable comprising a 19/conductor compact and awg No. 2/0 wires.

| | |
|---|---|
| 7/conductor core | 7–.0915 round; .232 inch compacting die |
| 12 outer conductors before shaping | .094 inch round to trapezoidal shape |
| 12 shaped outer conductors approx. | .074 inch high, .099 inch wide at top, .060 inch high at bottom |
| Groove dimension of trapezoid | .072 inch high × .102 inch wide (top) × .060 inch wide (bottom) |
| 19/conductor core | .376–.380 inch compacting die |
| Weight per 1,000 ft. | (A) 123.0 lbs. with .3745 inch diameter<br>(B) 125.4 lbs. with .380 inch diameter |
| ASTM diameter | .376 inch nominal, .380 inch maximum |
| ASTM weight | 125 lbs./M[1] nominal, 122.5 lbs. minimum |

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

What is claimed is:

1. Apparatus for the manufacture of cable formed by at least one dense, uniform lay of conductors received about and compacted on a core comprising (a) strander means, (b) a plurality of bobbins at least equal in number to the number of conductors in said lay supporting a substantially endless length of round conductor, each said bobbin being supported by said strander means whereby said conductor carried thereby is adapted to be played out during said manufacture, (c) forming apparatus likewise supported by said strander means, said forming apparatus including a plurality of former means, continuously receiving a single conductor, said former means including (1) a first roller having a cylindrical surface, (2) a second roller having a surface including a plurality of grooves of a non-round cross-section therealong for accommodating round conductors of different gage and for forming said conductor to a non-round configuration, and (3) mounting means for supporting said rollers for rotation about parallel axes, each said roller being disposed in position whereby said conductor is deformed substantially to the cross-section of said groove through rolling action of said first roller, (d) a die for compacting substantially simultaneously each of said conductors of said lay on said core, and (e) means for supporting said core for movement continuously to said die to receive said conductors of said lay, through said die and for moving said cable away from said die.

2. The apparatus of claim 1 wherein each groove is of a regular trapezoidal cross-section.

3. The apparatus of claim 1 wherein said forming apparatus includes a plate, said plate having an inner opening permitting movement of said core to said die and a plurality of faces around its circumference, said faces being equal in number to $3n^2+3n$ wherein n is the number of lays of conductors surrounding said core, and each former means supported on a face at equicircumferential dispositions.

4. The apparatus of claim 1 wherein said strander means is a tubular strander and said forming apparatus is disposed coaxially of said strander means.

5. The apparatus of claim 3 wherein each mounting means is mounted on a face of said plate.

6. A forming apparatus for use with a strander in the manufacture of cable having at least one dense, uniform lay of conductors surrounding a core comprising (a) a plate, said plate having an inner opening adapted to permit movement of said core to a downstream die at which it shall receive said lay of conductors to be compacted therearound and a plurality of faces around its circumference, said faces being equal in number to $3n^2+3n$ wherein n is the number of lays of conductors surrounding said core, (b) former means equal in number to the number of conductors in said surrounding lay including (1) a first roller having a cylindrical surface, (2) a second roller having a surface including a plurality of grooves therealong of a non-round cross-section for accommodating conductors of different gage, and (3) mounting means for supporting said rollers for rotation about parallel axes, each said roller being disposed in position whereby said conductor is deformed substantially to the cross-section of said groove through rolling action of said first roller, and (c) means for mounting each said former means on a face of said plate at equicircumferential dispositions.

7. The forming apparatus of claim 6 wherein each groove is of regular trapezoidal cross-section.

* * * * *